United States Patent [19]

Harada

[11] Patent Number: 4,871,274

[45] Date of Patent: Oct. 3, 1989

[54] TYPEWRITER

[75] Inventor: Yuichi Harada, Nagoya, Japan

[73] Assignee: Brother Kogyo Kabushiki Kaisha, Japan

[21] Appl. No.: 137,767

[22] Filed: Dec. 24, 1987

[30] Foreign Application Priority Data

Dec. 26, 1986 [JP] Japan ..... 61-313595

[51] Int. Cl.[4] ..... B41J 29/00; B41J 11/62

[52] U.S. Cl. ..... 400/697.1; 400/240.1; 400/186; 400/216.1; 400/703; 400/719

[58] Field of Search ..... 400/213, 215, 216, 240.1, 400/240.2, 240.3, 240.4, 212, 216.4, 216.5, 54, 196, 216.1, 697.1, 697, 703, 719

[56] References Cited

U.S. PATENT DOCUMENTS

| | | | |
|---|---|---|---|
| 3,802,939 | 5/1975 | Morelli | 400/216 X |
| 4,460,287 | 7/1984 | Theilen et al. | 400/216 X |
| 4,611,938 | 9/1986 | Rettke et al. | 400/213.1 X |
| 4,613,248 | 9/1986 | Iwase et al. | 400/240.1 X |
| 4,746,235 | 5/1985 | Mueller et al. | 400/54 X |

FOREIGN PATENT DOCUMENTS

| | | | |
|---|---|---|---|
| 83088 | 4/1966 | Japan | 400/216 |
| 57377 | 3/1980 | Japan | 400/216 |
| 78685 | 4/1980 | Japan | 400/212 |
| 12891 | 1/1984 | Japan | 400/212 |
| 222374 | 12/1984 | Japan | 400/54 |
| 205177 | 4/1986 | Japan | 400/216 |
| 116574 | 6/1986 | Japan | 400/212 |
| 154980 | 7/1986 | Japan | 400/212 |
| 2171057 | 7/1986 | United Kingdom | 400/212 |

*Primary Examiner*—Edgar S. Burr
*Assistant Examiner*—James R. McDaniel
*Attorney, Agent, or Firm*—Kane, Dalsimer, Sullivan, Kurucz, Levy, Eisele and Richard

[57] ABSTRACT

Disclosed is a typewriter wherein a ribbon holder mounted on a carriage movable along a platen holds both a print ribbon and a correction ribbon thereon and is displaceable between its first lift position for facing the print ribbon to a print point on the platen and its second lift position for facing the correction ribbon to said print point.

The disclosed typewriter is provided with lift means for displacing the ribbon holder between its first and second lift position, detecting means for detecting the lift position of the ribbon holder, and control means for controlling the lift means to displace the ribbon holder in response to the result of detection of the detecting means, thereby the possibility of errorneous initial printing is eliminated, which may occur when a power supply is once turned off during a correcting action with a correction ribbon and then is turned on again to perform a normal print operation.

5 Claims, 6 Drawing Sheets

| |
|---|
| FIG.5(a) |
| FIG.5(b) |

TYPEWRITER

BACKGROUND OF THE INVENTION

This invention relates to a typewriter, and more particularly to an electric typewriter having a ribbon holder on a carriage movable along a platen, wherein the ribbon holder supports both a print ribbon and a correction ribbon and is selectively displaceable to a first lift position for facing the print ribbon to a print point on the platen or to a second lift position for facing the correction ribbon to the print point on the platen.

Conventionally, there is known a typewriter as disclosed in the U.S. Ser. No. 813883 filed on Dec. 27, 1985, wherein the ribbon holder mounted on the carriage is swung by a ribbon lift cam rotated by means of a motor in order to shift the ribbon holder between its first and second positions.

In such conventional typewriter, however, there exists a problem that when it is switched off during the erasing action with the correction ribbon, the correction ribbon is retained at its operating position. Thereafter, when a normal print operation is to be resumed by switching on a power source, the interrupted corrective action is first executed with the correction ribbon to consequently bring about failure in performing an initial print.

SUMMARY OF THE INVENTION

It is therefore an object of this invention to provide an improved typewriter capable of preventing the possibility of erroneous initial printing which may occur when a power supply is once turned off during a correcting action with a correction ribbon and then is turned on again to perform a normal print operation.

For the above purpose, according to the invention, there is provided a typewriter wherein a ribbon holder mounted on a carriage movable along a platen holds both a print ribbon and a correction ribbon thereon and is displaceable between its first lift position for facing said print ribbon to a print point on said platen and its second lift position for facing said correction ribbon to said print point, which comprises: lift means for displacing said ribbon holder between its first and second lift positions; detecting means for detecting the lift position of said ribbon holder; control means for controlling said lift means to displace said ribbon holder in response to the result of detection of said detecting means.

According to another aspect of the invention, there is provided a typewriter wherein a ribbon holder mounted on a carriage movable along a platen holds both a print ribbon and a correction ribbon thereon and is displaceable between its first lift position for facing said print ribbon to said platen and its second lift position for facing said correction ribbon to said platen, which comprises: a switch member mounted on said carriage; a first actuating member mounted on said carriage, said first actuating member turning said switch member on or off upon the displacement of said ribbon holder for detecting the lift position of said ribbon holder; and a second actuating member fixed at a position corresponding to a predetermined original position of said carriage, said second actuating member turning said switch member on or off when said carriage is at its original position.

With the above constructed typewriter, since the original position of the carriage can be detected by the switch member provided for detecting the lift position of the ribbon holder, any particular switch for sole detection of the carriage original position is no longer required to eventually reduce the component elements with an advantage of lower production cost.

BRIEF DESCRIPTION OF THE ACCOMPANYING DRAWINGS

DESCRIPTION OF THE PREFERRED EMBODIMENTS

Figure 1:
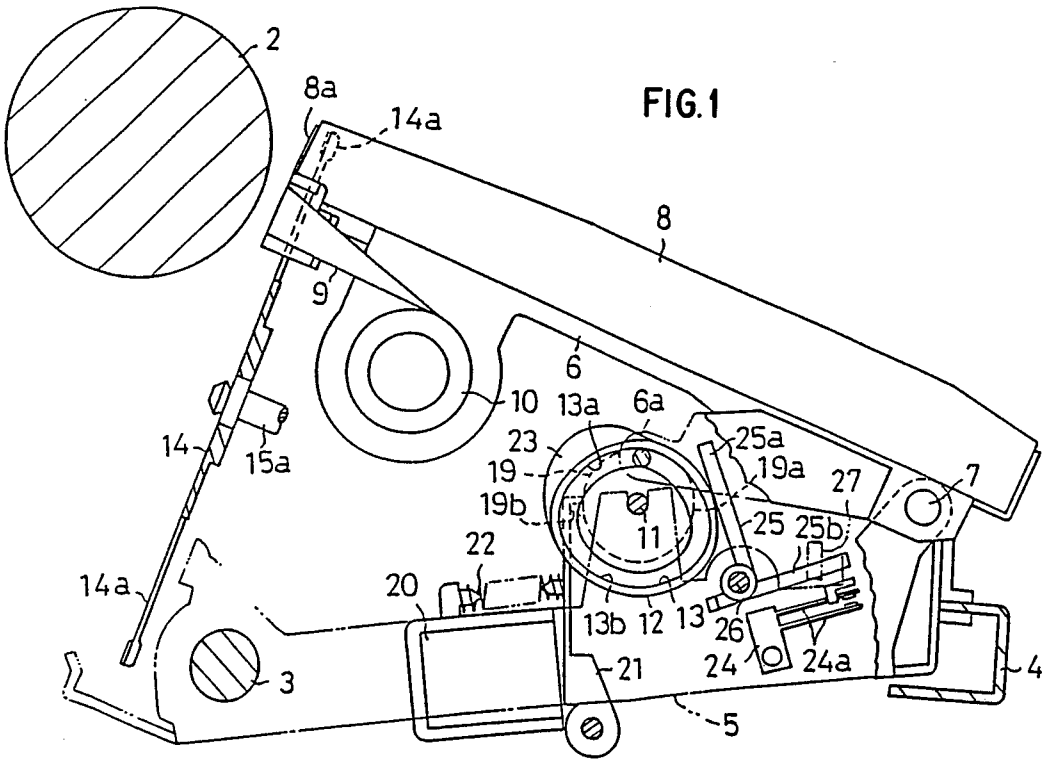
FIG. 1 is a partial sectional side view of a typewriter embodying the invention, in which a ribbon holder thereof is displaced to its first lift position.
Figure 2:
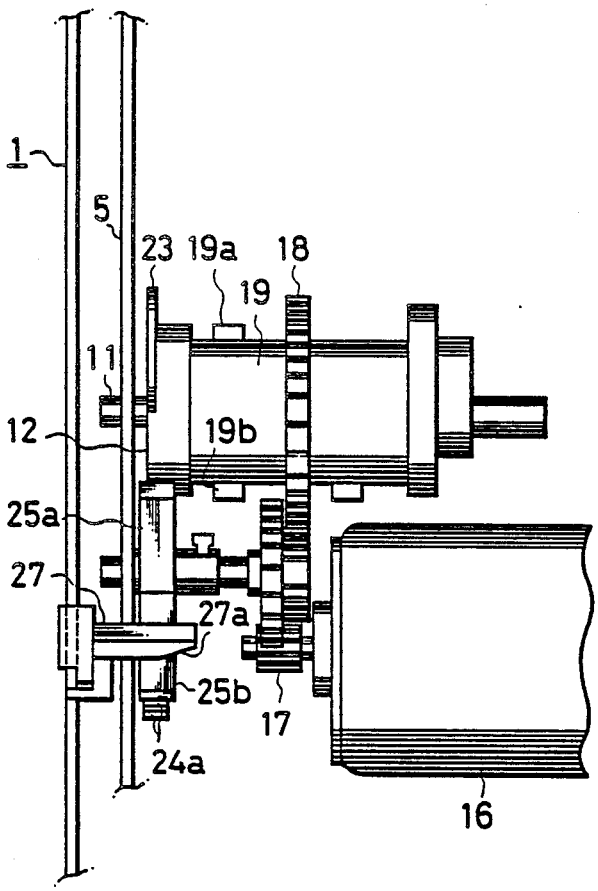
FIG. 2 is a partial plan view of a carriage of the typewriter.
Figure 3:
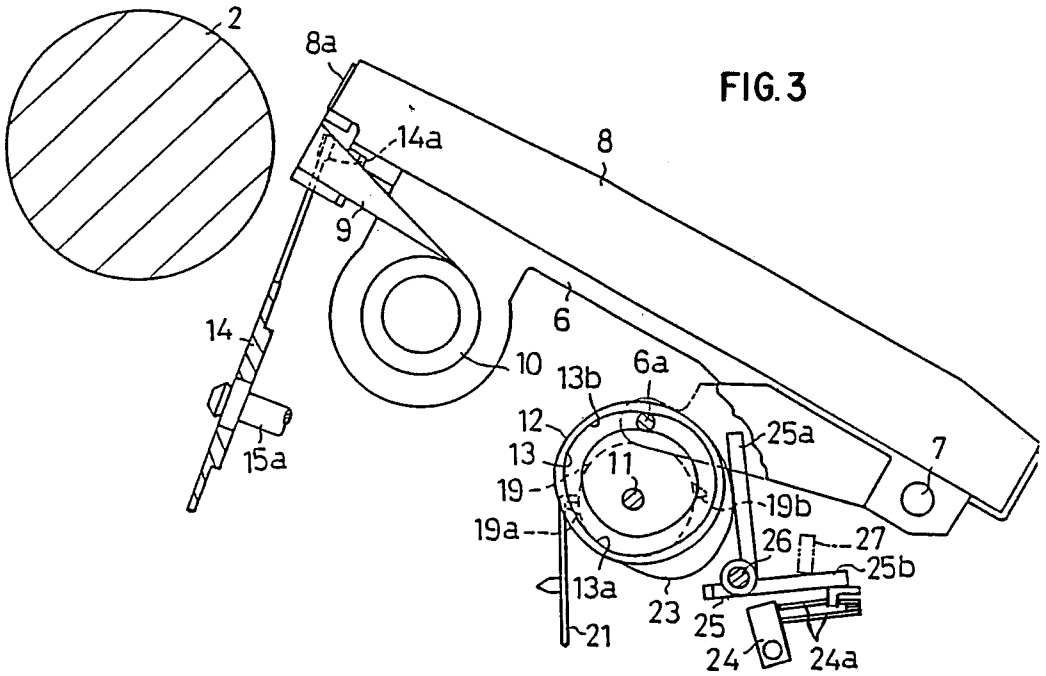
FIG. 3 is a partial sectional side view of the carriage, in which the ribbon holder is displaced to its second lift position.

As illustrated in FIGS. 1 through 3, a platen 2 is rotatably supported by a frame of a typewriter, and a guide shaft 3 and a guide rail 4 extend in parallel with the platen 2. A carriage 5 is so supported on the guide shaft 4 and the guide rail 4 as to be movable along the platen 2, and is actuated by a carriage drive motor 37 (see FIG. 4) consisting of a stepping motor.

In an upper portion of the carriage 5, a ribbon holder 6 is swingably mounted on a shaft 7. A ribbon cassette 8 containing a print ribbon 8*a* is partially exposed in such a manner as to be runnable along the platen 2. On both sides of the ribbon holder 6, there are rotatably disposed a supply spool 10 with a roll of unused correction ribbon 9 and a take-up spool, not shown, for winding a used correction ribbon 9 therearound, wherein the running portion of the correction ribbon 9 between the two spools is positioned below the exposed portion of the print ribbon 8*a*.

A ribbon lift cam 12 is rotatably supported by a shaft 11 provided in the carriage 5, and a grooved cam 13 having a small-diameter portion 13*a* and a large-diameter portion 13*b* is formed on one side of the ribbon lift cam 12. A follower pin 6*a* engageable with the grooved cam 13 projects from the ribbon holder 6 and, when the follower pin 6*a* is brought into engagement with the small-diameter portion 13*a* as illustrated in FIG. 1, the ribbon holder 6 is set at a first lift position where the print ribbon 8*a* is placed opposite to a print point on the platen 2. On the other hand, when the pin 6*a* is brought into engagement with the large-diameter portion 13*b* as illustrated in FIG. 3, the ribbon holder 6 is set at a second lift position where the correction ribbon 9 is placed opposite to the print point on the platen 2.

Figure 4:
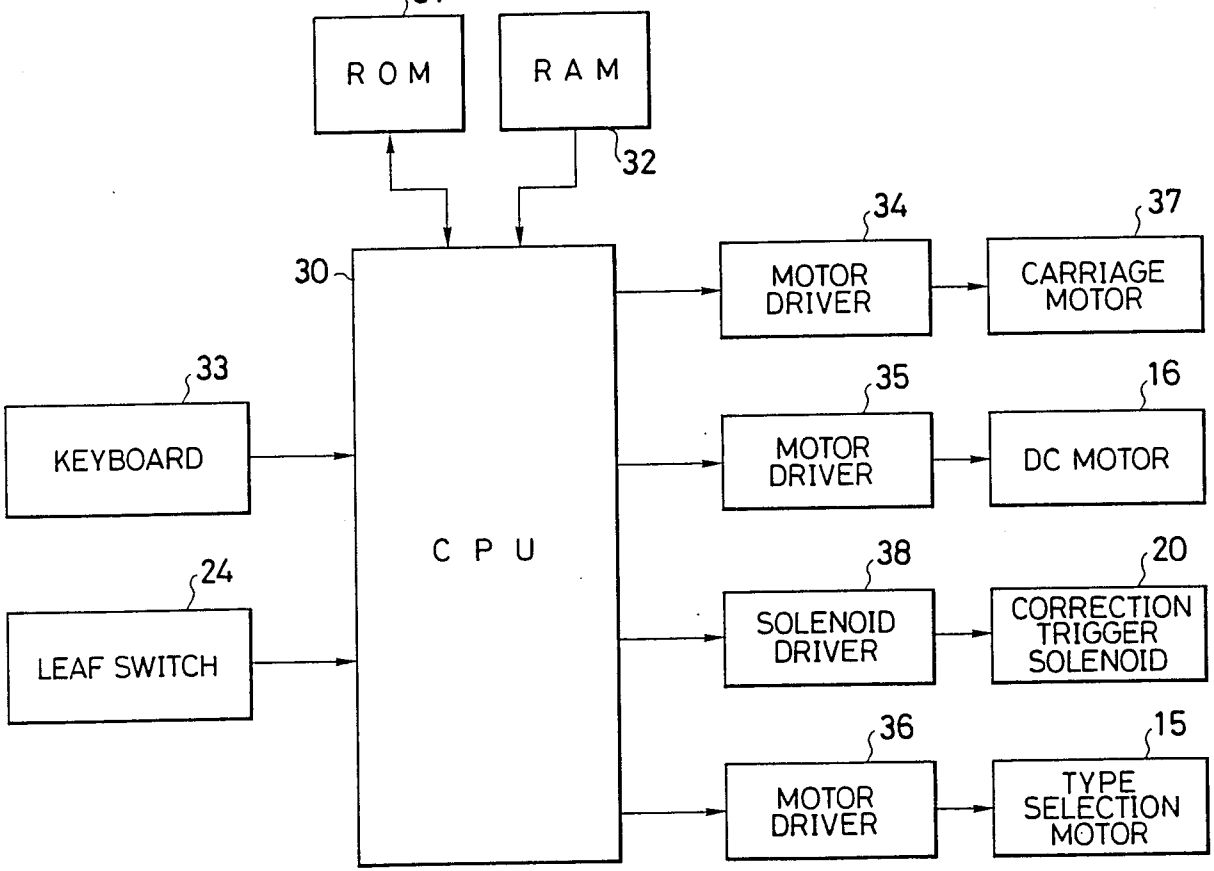
FIG. 4 is a block diagram showing an electrical constitution of the typewriter.

A petal-shaped typewheel 14 having a multiplicity of type elements 14*a* along its periphery is disposed on the carriage 5 proximate to the platen 2 and is connected through its central portion to a motor shaft 15*a* of a type selection motor 15 (see FIG. 4). With rotation of the type selection motor 15, one type element 14*a* is selectively placed at the print position opposite to the platen 2. When such type element 14*a* is struck by print hammer, not shown, a desired character is printed through the print ribbon 8*a* onto a sheet of paper on the platen 2 or a misprinted character is erased through the correction ribbon 9.

A driven gear 18 is rotatably supported by the shaft 11 and is rotated through a gear transmission mechanism 17 by a DC (direct-current) motor 16 which is provided to perform a ribbon lift operation and a type strike operation with a printing hammer. On the shaft 11, mounted is a clutch collar 19 constituting a clutch mechanism to transmit or interrupt the rotation of the driven gear 18 to the ribbon lift cam 12. The clutch collar 19 has, on its periphery, a pair of projections **19*a* and 19*b* at an equiangular interval in such a manner that when the rotation of the clutch collar 19 is restrained through the projections 19*a* and 19*b* as described later, transmission of the rotation from the driven gear 18 to the ribbon cam 12 is interrupted by the action of a clutch spring, not shown, in the collar 19, but when the rotation of the clutch collar 19 is not restrained, the rotation of the driven gear 18 is transmitted to the ribbon lift cam 12 by the action of the clutch spring to thereby rotate the ribbon lift cam 12 in a clockwise direction in FIG. 1**.

A correction trigger solenoid 20 is mounted on the carriage 5 below the left side of the ribbon lift cam 12. An armature 21 is rotatably supported in the vicinity of the solenoid 20 and is biased by a spring 22 in a clockwise direction in FIG. 1. When the armature 21 is attracted against the biasing force of the spring 22 upon energization of the solenoid 20, a bent end of the armature 21 is displaced outward from the rotational locus of the projections **19*a* and 19*b*. On the other hand, if the solenoid 20 is deenergized, the armature 21 is moved into the rotational locus of the projections 19*a* and 19*b* by the biasing force of the spring 22 and is thereby engaged with the projection 19*a* or 19*b***.

A semicircular cam lobe 23 is formed integrally with the periphery of the ribbon lift cam 12, and a leaf switch (hereinafter referred to simply as "switch") 24 having a pair of contacts **24*a* is attached to the carriage 5 below the right side of the ribbon lift cam 12 in FIG. 1. Between the ribbon lift cam 12 and the switch 24, a substantially L-shaped actuating member 25 is rotatably supported at its intermediate portion by a shaft 26, and its one arm 25*a* is biased so as to rotate in a counterclockwise direction in FIG. 1 by a torsion spring, not shown, wound on the shaft 26 so as to contact the cam lobe 23. Due to such contact with the cam lobe 23, the actuating member 25 is reciprocatively rotated between a non-operating position illustrated in FIG. 1 and an operating position illustrated in FIG. 3, whereby the two contacts 24*a* of the switch 24 are mutually opened or closed by another arm 25*b* of the actuating member 25 to turn on or off the switch 24**.

In the meantime, on a left side wall of the frame 1 along the locus of movement of the carriage 5, there is formed, as shown in FIG. 2, a look member 27 which projects inward and has an inclined surface **27*a* in such a manner that the arm 25*a* of the actuating member 25 is contactable with or discontactable from the inclined surface 27*a* of the lock member 27. Upon arrival of the carriage 5 at the left end of its displacement range, the other arm 25*b* of the actuating member 25 contacts the inclined surface 27*a* of the lock member 27 and is thereby rotated along the inclined surface 27*a* from its non-operating position illustrated in FIG. 1 to its operating position in FIG. 3, hence turning on the switch 24**.

Now the electrical constitution for operating the mechanism illustrated in FIGS. 1 through 3 will be described with reference to FIG. 4. To a CPU (central processing unit) 30, a ROM (read only memory) 31 and a RAM (random access memory) 32 are connected. Desired control signals are inputted to the CPU 30 by manipulating various keys arrayed on a keyboard 33. In response to such input control signals, the CPU 30 controls the carriage drive motor 371 the DC motor 16, the type selection motor 15 and the solenoid 20 via motor drivers 34, 35, 36 and a solenoid driver 38, respectively. The CPU 30 is fed also with a predetermined detection signal from the switch 24.

Figures 5, 5A:
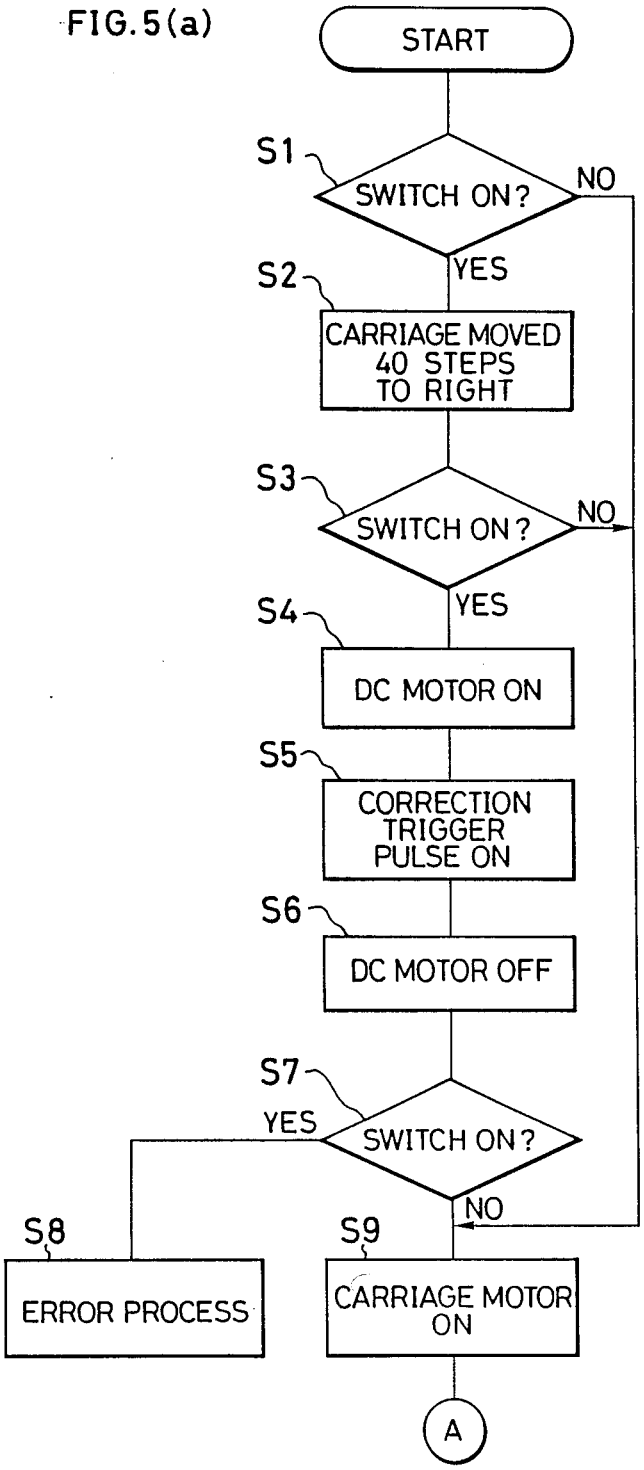
FIGS. 5, 5A and 5B are a flow chart showing the operation of the typewriter.
Figure 5B:
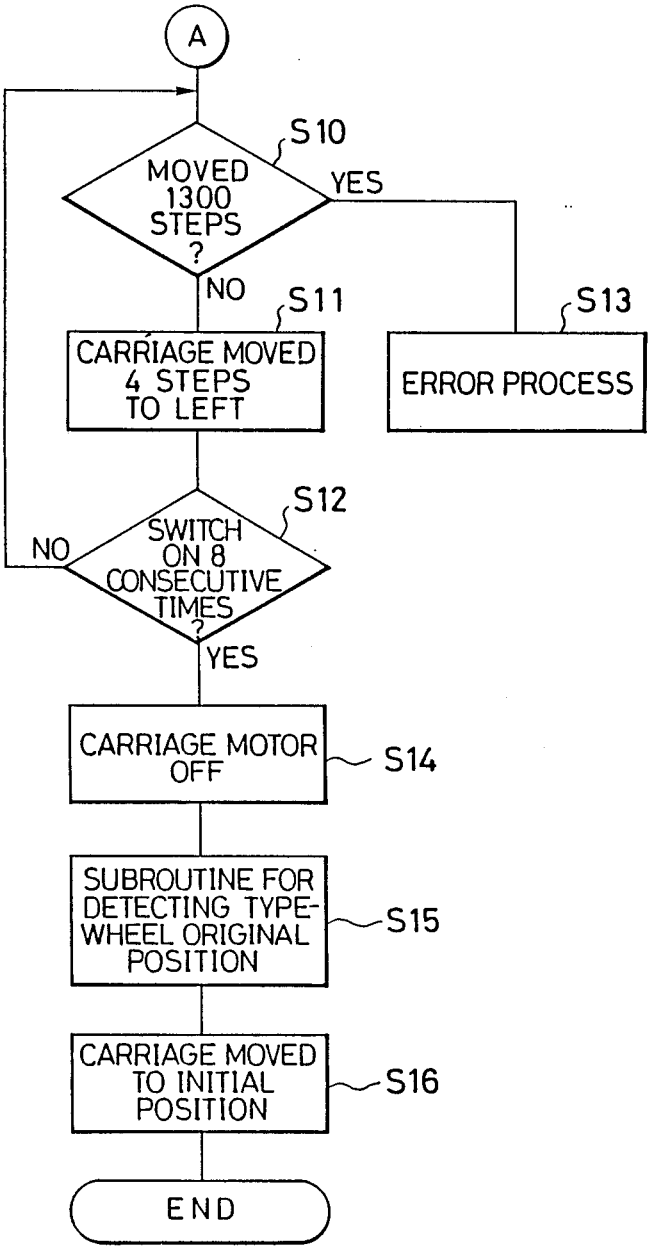

As illustrated in FIGS. 5(*a*) and 5(*b*), when a power source, not shown, is turned on, first the ribbon lift position is detected. The CPU 30 decides whether the switch 24 is in its on-state or not in STEP S1. If the result of such decision is YES which denotes an on-state, the carriage motor 37 is driven to move the carriage 5 rightward by a predetermined number of steps, for instance 40 steps, so that, even if the carriage 5 was at the left end of the frame 1, the actuating member 25 on the carriage 5 is disengaged from the lock member 27. Under this condition, the on-off state of the switch 24 is determined solely by the state of engagement between the cam lobe 23 and the actuating member 25.

Next in STEP S3, the on-off state of the switch 24 is judged again by the CPU 30. The on-state represents that the actuating member 25 is in engagement with the cam lobe 23 as illustrated in FIG. 3 to turn on the switch 24, where the ribbon holder 6 is placed at its second lift position. Therefore the CPU 30 drives the DC motor 16 in STEP S4 and then outputs a trigger pulse to the correction trigger solenoid 20 for a predetermined time in STEP S5. Subsequently, the procedure advances to STEP S6 where the DC motor 16 is brought to a halt.

When the solenoid 20 is energized, the armature 21 is attracted, so that its fore end is disengaged from the projection **19*a* of the clutch collar 19. Then the rotation of the driven gear 18 is transmitted to the ribbon lift cam 12 by the clutch mechanism and the cam 12 rotates in the clockwise direction in FIG. 3. Then, before the other projection 19*b* of the clutch collar 19 approaches to the fore end of the armature 21, the solenoid 20 is deenergized and the fore end of the armature 21 is shifted into the rotational locus of the other projection 19*b* by the biasing force of the spring 22. With the subsequent rotation of the clutch collar 19, the other projection 19*b* is engaged with the armature 21 as illustrated in FIG. 1 to consequently restrain the rotation of the clutch collar 19, whereby the ribbon lift cam 12** is brought to a half after its half rotation.

With such rotation of the ribbon lift cam 12, the ribbon holder 6 is moved downward from the second lift position in FIG. 3 to the first lift position in FIG. 1 through engagement of the follower pin **6*a* with the grooved cam 13, so that the print ribbon 8*a* is faced to the platen 2**.

Next in STEP S7, a judgement is made again by the CPU 30 with regard to the on-off state of the switch 24. If the result is the off-state, a predetermined error process is executed in STEP S8 such as sounding a buzzer or the like. On the other hand, if each result of the judgements in STEP S7 and the foregoing STEP S1 and STEP S3 is NO which represents the off-state of the switch 24, the detection procedures of the ribbon lift position terminate and the procedure advances to STEP S9 for detecting the carriage original position.

In STEP S9, the CPU 30 starts driving the carriage motor 37. In STEP S10 through STEP S12, a decision is made as to whether the switch 24 is turned on or not in prevent an initial print error which may otherwise be response to every, for instance, 4-steps motion of the carriage motor 37. That is, in the state of FIG. 1 where the ribbon holder 6 is placed at the first lift position with the switch 24 turned off, the carriage 5 is moved leftward at a rate of 4 steps each time by the carriage motor 37. When the other arm 25*b* of the actuating member 25 contacts the inclined surface 27*a* of the lock member 27, the actuating member 25 is rotated in the clockwise direction in FIG. 1. As a result, the switch 24 is turned on as in the case where the ribbon holder 6 is placed at the second lift position. Then, when on-signals have been fed from the switch 24 eight times consecutively, the CPU 30 halts the carriage motor 37 to hold the carriage 5 at its original position, thereby completing the process of detecting the carriage original position.

After the leftward movement of the carriage 5 is regulated by the frame 1 during such operation, the carriage motor 37 is stepped out. In case the result of STEP S12 fails to become YES even if the carriage motor 37 is driven 1300 steps corresponding to the entire range of movement of the carriage 5, the CPU 30 executes a predetermined error process in STEP S13.

On the other hand, in case the result of STEP S12 becomes YES, the CPU 30 halts the carriage motor 37 in STEP S14. Then, after detecting the typewheel original position in STEP S15, the CPU 30 moles the carriage 5 to the print start position in STEP S16. Consequently, the user is enabled to start a normal print operation immediately by manipulating the keys on the keyboard 33 and is therefore kept free from erroneous use of the correction ribbon 9 at the resumption of a print mode.

As described above, the lift position of the ribbon holder 6 can be confirmed prior to starting a print operation, and the print ribbon 8*a* is set without fail at its predetermined position facing the print point on the platen 2, so that it becomes possible to prevent an initial print error which may otherwise be caused in case the power supply is once turned off during the correction mode and then is turned on again to resume the normal print operation. Furthermore, since the original position of the carriage 3 can be detected by the switch 24 provided for detecting the lift position of the ribbon holder 6, any particular switch for sole detection of the carriage original position is no longer required to eventually reduce the component elements with an advantage of lower production cost.

It is to be understood that the application of the invention is not limited to the above embodiments. For example, the switch may be mounted on the carriage 5 in such a manner as to be directly turned on or off through engagement with the ribbon holder 6, and the structures of the individual mechanism may be modified as described within the scope not departing from the spirit of the invention.

What is claimed is:

4. The typewriter according to claim 3 wherein said clutch means includes a clutch collar having an outer periphery on which a pair of projections are formed at an equiangular interval, and said lift means further comprises a solenoid with an armature being normally biased toward said clutch collar and engaged with one of said projections so as not to transmit the rotation of said motor to said lift cam, said armature being disengaged from said one of projections if said solenoid is engaged by said control means.

1. A typewriter wherein a ribbon holder mounted on a carriage movable along a platen holds both a print ribbon and a correction ribbon thereon and is displaceable between a first lift position for facing said print ribbon to said platen and a second lift position for facing said correction ribbon to said platen, which comprises:

a single switch member mounted on said carriage;

a first actuating member mounted on said carriage, said first actuating member turning said single switch member on or off upon the displacement of said ribbon holder for detecting the lift position of said ribbon holder;

a second actuating member fixed at a position corresponding to a predetermined original position of said carriage, said second actuating member turning said single switch member on or off when said carriage is at its original position;

first moving means for moving said carriage at a predetermined amount away from said original position thereof to ensure the disengagement of said switch member from said second actuating member;

first confirming means for confirming said ribbon holder being at its predetermined lift position after the movement by said first moving means;

second moving means for moving said carriage per said predetermined amount toward said original position thereof after the confirmation by said first confirming means; and second confirming means for confirming said carriage being placed at its original position.

2. A typewriter wherein a ribbon holder mounted on a carriage movable along a platen holds both a print ribbon and a correction ribbon thereon and is displaceable between a first lift position for facing said print ribbon to a print point on said platen and a second lift position for facing said correction ribbon to said print point, which comprises:

lift means comprising a rotatable lift cam provided at one side thereof with a grooved cam having a small-diameter portion and a large-diameter portion for displacing said ribbon holder between said first and second lift positions;

a switch member mounted on said carriage;

a first actuating member comprising a substantially two-armed member swingably mounted on said carriage, one of said arms being biased to swing in the direction to contact the peripheral portion of said lift cam, and wherein said lift cam is provided with a semicircular cam lobe fixedly mounted thereto, another arm of said actuating member being swung to its operating position, said first actuating member turning said switch member on or off upon the displacement of said ribbon holder where said switch is turned on, when said one of said arms contacts said cam lobe;

a second actuating member fixed at a position corresponding to a predetermined original position of said carriage, said second actuating member turning said switch member on or off when said carriage is at its original position; and, control means for positioning said ribbon holder at its first lift position and said carriage at its predetermined position based upon the on-off state of said switch member.

3. The typewriter according to claim 2 wherein said lift means further comprises a rotating means for rotating said lift cam, said rotating means being coupled to said lift cam through clutch means to interrupt the transmitting of the rotary force of said rotating means to said lift cam; and wherein said ribbon holder is provided with a follower pin to be engaged in said grooved cam, said ribbon holder being displaced with said follower pin engaging in said small-diameter portion or in said large diameter portion of a said grooved cam, alternated upon the rotation of said lift cam.

5. The typewriter according to claim 3 wherein said second actuating member is provided with an inclined surface, and wherein said another of said actuating member is swung to its operating position when said carriage is moved to its initial position, where said another arm contacts said inclined surface of said second actuating member.

* * * * *